US009635730B2

(12) United States Patent
Baaijens et al.

(10) Patent No.: US 9,635,730 B2
(45) Date of Patent: Apr. 25, 2017

(54) COLOR EMPHASIS AND PRESERVATION OF OBJECTS USING REFLECTION SPECTRA

(71) Applicant: PHILIPS LIGHTING HOLDING B.V., Eindhoven (NL)

(72) Inventors: Johannes Petrus Wilhelmus Baaijens, Eindhoven (NL); Willem Piet Van Hoof, Horst (NL); Andrew Ulrich Rutgers, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/966,607

(22) Filed: Dec. 11, 2015

(65) Prior Publication Data

US 2016/0100472 A1 Apr. 7, 2016

Related U.S. Application Data

(63) Continuation of application No. 14/417,203, filed as application No. PCT/IB2013/055814 on Jul. 15, 2013, now Pat. No. 9,345,099.

(Continued)

(51) Int. Cl.

*H05B 33/08* (2006.01)
*A47F 3/00* (2006.01)

(Continued)

(52) U.S. Cl.

CPC ..... *H05B 33/0872* (2013.01); *A47F 3/001* (2013.01); *G09F 13/00* (2013.01);

(Continued)

(58) Field of Classification Search

CPC ..... H05B 33/0872; H05B 33/0869; H05B 37/0227

(Continued)

(56) References Cited

U.S. PATENT DOCUMENTS 3,750,883 A 8/1973 Irving et al.
7,321,109 B2 1/2008 Shur et al.

(Continued)

FOREIGN PATENT DOCUMENTS

DE 102010041856 A1 5/2012
EP 2197248 A1 6/2010

(Continued)

*Primary Examiner* — Douglas W Owens
*Assistant Examiner* — Jonathan Cooper

(57) ABSTRACT

A lighting arrangement (100, 300, 400, 600) configured to illuminate an object (108, 308, 408, 608), the lighting arrangement (100, 300, 400, 600) configured to emit light of a plurality of colors, and a control unit for controlling mixed light emitted by the lighting arrangement is disclosed. The control unit is configured to determine the object (108, 308, 408, 608) to be illuminated and to receive a reflection spectrum of the object. Then, the control unit selects control parameters for mixed light emitted by the lighting arrangement, the mixed light having an illumination spectrum matching the reflection spectrum of the object based on predetermined parameters relating to the type of object. Furthermore, the lighting arrangement illuminates the object based on the selected control parameters provided by the control unit. A corresponding method and a computer program product are also disclosed.

19 Claims, 5 Drawing Sheets

Related U.S. Application Data

(60) Provisional application No. 61/676,460, filed on Jul. 27, 2012.

(51) Int. Cl.
*G09F 13/00* (2006.01)
*H05B 37/02* (2006.01)
*G09F 13/22* (2006.01)

(52) U.S. Cl.
CPC ..... *G09F 13/22* (2013.01); *H05B 33/0869* (2013.01); *H05B 37/0227* (2013.01); *G09F 2013/222* (2013.01)

(58) Field of Classification Search
USPC ..... 315/148–153
See application file for complete search history.

(56) References Cited

U.S. PATENT DOCUMENTS

| | | | | |
|---|---|---|---|---|
| 7,652,236 | B2 | 1/2010 | Cortenraad et al. | |
| 7,729,941 | B2 | 6/2010 | Zampini et al. | |
| 7,756,328 | B2 | 7/2010 | Komiya et al. | |
| 8,023,736 | B2 | 9/2011 | Tsukada | |
| 2004/0105264 | A1 | 6/2004 | Spero | |
| 2008/0012722 | A1 | 1/2008 | Moseley | |
| 2008/0136356 | A1 | 6/2008 | Zampini et al. | |
| 2008/0258590 | A1* | 10/2008 | Van De Sluis | A47F 3/001 312/237 |
| 2009/0251077 | A1* | 10/2009 | Wilborn | A41D 27/085 315/313 |
| 2010/0090603 | A1* | 4/2010 | Schofield | G05D 1/0244 315/82 |
| 2010/0188022 | A1 | 7/2010 | Gerlach et al. | |
| 2010/0194291 | A1* | 8/2010 | Ishiwata | H05B 33/0863 315/153 |
| 2011/0068698 | A1 | 3/2011 | Swoboda et al. | |
| 2015/0230316 | A1* | 8/2015 | Baaijens | H05B 33/0869 315/153 |

FOREIGN PATENT DOCUMENTS

| | | | |
|---|---|---|---|
| EP | 2473008 | A2 | 1/2012 |
| JP | 2008/270089 | * | 11/2008 |
| JP | 2008264430 | A | 11/2008 |
| JP | 2008270089 | A | 11/2008 |
| JP | 2011/040241 | * | 2/2011 |
| JP | 2011040241 | A | 2/2011 |
| WO | 2009019120 | A1 | 2/2009 |
| WO | 2011070473 | A1 | 6/2011 |
| WO | 2011092625 | A1 | 8/2011 |

* cited by examiner

COLOR EMPHASIS AND PRESERVATION OF OBJECTS USING REFLECTION SPECTRA

CROSS-REFERENCE TO PRIOR APPLICATIONS

This application is a continuation of U.S. patent application Ser. No. 14/417,203, filed on Jan. 26, 2015, which is a U.S. National Phase application under 35 U.S.C. §371 of International Application No. PCT/IB2013/055814, filed on Jul. 15, 2013, which claims the benefit of U.S. Provisional Patent Application No. 61/676,460, filed on Jul. 27, 2012. These applications are hereby incorporated by reference herein.

FIELD OF THE INVENTION

The present invention generally relates to a lighting arrangement configured to illuminate an object, a method for controlling the lighting arrangement and computer program product for controlling the color mixing of light emitted by the lighting arrangement for illuminating an object and to enhance the perception of the object.

BACKGROUND OF THE INVENTION

Generally, objects such as signs, objects in museum, artifacts and products are designed and displayed to catch the attention and the interest of viewers. Recently, lighting has become a tool to further enhance the appearance and to emphasize an object and is not only used to increase the illumination of the object, i.e. to avoid dim lighting. Correspondingly, the interest of using color mixing light sources combining light emitting diodes emitting light with different colors to achieve for example white light are increased and are today commonly used in both commercial and domestic establishments. A color mixing light source most often comprises of a plurality of light sources each emitting a specific color and offers the possibility of manipulating the emitted light to further enhance the object.

However, without the help of a professional lighting expert it may be difficult to be able to set brightness, color and saturation parameters of the light emitted by a color mixing light source such that the appearance of the object is enhanced while the object remains undamaged by the lighting. Due to the rather intricate adjustments of the color mixing light source, the increased demand for color mixing light sources has encouraged a development in methods for the control of the color mixing light with little or no user input. Furthermore, there are several applications where it may be interesting to make a product stand out from the surroundings, for by example emphasizing a specific color of the object. Furthermore, some objects, in for example a museum, may be sensitive to external influences including lighting which may cause damage in priceless historical artifacts. The damage caused by lighting often occurs due to that the object, e.g. an artifact is heated by the incident light or by a photochemical reaction that relates to light being absorbed by the artifact, for example triggering a chemical reaction.

In WO2011/092625 a method and corresponding system is disclosed for controlling a color adjustable light source configured to illuminate an object based on a specific color of the object, where the saturation component of the specific color is mixed into the illuminating light to enhance that particular color with regards to the color temperature.

Although providing an improved automatic control for the color adjustable light source in WO2011/092625, the enhancement of the object is restricted to the given color information of the object and a lot of information that can be utilized from the object is discarded. For some objects, it may prove to be difficult to determine a specific color to enhance and the discarded information could be used to adjust the illumination light in an improved fashion such as to obtain illumination light that better boosts the perception of the object according to a more comprehensive picture while reducing the physical influence of the object caused by the light, such as faded colors. Hence, there is a need for an improved lighting arrangement, computer program product and method of controlling a color mixing light source for highlighting an object by utilizing more information obtainable from the object illuminated.

SUMMARY OF THE INVENTION

In view of the above-mentioned and other drawbacks of the prior art, it is an aspect of the present invention to provide an easy-to-use illumination arrangement with the ability to adjust the illumination to enhance the object with regards to the reflections spectrum of the object at multiple wavelengths and to the human eye perception while keeping the physical light influences of the object at a minimum.

Physical influences of the object caused by light should be understood as an object illuminated with a wavelength of light which is absorbed by the object and causes heating or photochemical processes in the object.

According to an aspect of the invention, the above is at least partly met by a lighting arrangement configured to illuminate an object, the lighting arrangement configured to emit light of a plurality of colors, and a control unit for controlling the lighting arrangement, wherein the control unit is configured to determine the type of object to be illuminated, receive a reflection spectrum of the object, select control parameters for controlling mixed light emitted by the lighting arrangement, the mixed light having an illumination spectrum matching the reflection spectrum of the object based on predetermined parameters relating to the type of object, and control the mixed light emitted by the lighting arrangement for illuminating the object based on the selected control parameters.

The lighting arrangement may be provided with a light-emitting device comprising a plurality of light sources for illuminating an object. Furthermore, the light sources may also mean any color mixing light source that comprises more than 3 different colors, such as a RGBW or RGBA color mixing light source. Further, light emitting diodes (LEDs) with a narrow emission peak in the output spectrum can be combined with light sources with a wider output spectrum emitting such as light perceived as white light. The light sources with a wider output spectrum may for example be phosphor converted light emitting diodes. The lighting arrangement may also comprise a single LED source with tuned phosphor elements.

According to one embodiment of the invention, the mixed light emitted by the lighting arrangement is provided by a plurality of light sources. The plurality of light sources may comprise any type of color mixing light source with more than 3 different colors, such as RGBW or a RGBA color mixing light source. The plurality of light sources may include light emitting diodes, lasers or phosphor converted light emitting diodes.

The illuminating spectrum of the light sources may be a combination of the spectral distribution of each of the plurality of light sources (or the light source with tuned phosphor elements as discussed above) in the lighting arrangement. The term color should be understood to refer to any light wavelength between 400 nm and 720 nm, or any combination of different light wavelengths within the visible spectrum.

It should be noted that within the context of the application the term object may be any type of physical object also including products displayed to a customer, artifacts, paintings, photosensitive objects, photosensitive materials, historical artifacts, commercial products, art, signs, window displays or surfaces, such as walls, ceilings, floors or other types of surfaces. The type of object may be divided into two groups: either photosensitive objects such as works of art, historical objects or objects of light sensitive material or objects where photosensitivity is not an issue, such as signs, food, and commercial product for example packaging for consumer products.

The present invention is based on the realization that by analyzing the reflection spectrum of the object and matching the power distribution of the illuminating spectrum with the power distribution of the reflection spectrum of the illuminated object at corresponding wavelengths, several colors of the object may be enhanced simultaneously by way of using wavelength dependent information obtained from the object. Additionally, matching the illumination spectrum with the reflection spectrum of the illuminated object may further reduce damages to the object that may be occurring from illuminating the object. Correspondingly, light reflected of an object may not influence the object by heat or by inducing photochemical processes in the object, instead those processes requires light to be absorbed by the object.

By considering the (e.g. complete) reflection spectrum of the object, a more complete view of the reality is presented, since even though an object is perceived as emitting a certain color such as yellow, the reflection spectrum may reveal a broad range of higher reflection extending between the wavelengths 500-700 nm, which corresponds to colors between green and red, instead of as the intuitive notion of a reflection spectrum with a clear peak wavelength around 570-590 nm which corresponds to yellow light.

Depending on the type of object the lighting arrangement is often located in different settings that may place different demands on the emitted light. If the object is a fruit such as an orange, the illumination arrangement may be arranged in a store. In a store setting customers will also very likely be illuminated by the light emitted by the lighting arrangement apart from the product. An example of this may be a customer selecting oranges from a display illuminated by the lighting arrangement. In alternative implementation, such as in a museum, the lighting arrangement is often arranged to illuminate the paintings directly. Thus, the visitors are not illuminated by the light from the lighting arrangement. Therefore, the light emitted from the lighting arrangement arranged in a store illuminating products may need to adjust the composition of the light such that the light will be perceived as "white" or close to white light so the customers are not walking around looking for example green. For the case with the painting in the museum, the surroundings are not of the same importance because the visitors are not illuminated by the lighting arrangement and the desire to alter the composition of the light due to the visitors is less important, however the light directed towards the painting may instead need adjustments due to reduce damage to the painting caused by lighting.

According to one embodiment of the invention, the predetermined parameters comprises a predetermined minimum color rendering index level of the mixed light emitted by the lighting arrangement and the control parameters for the mixed light emitted by the lighting arrangement are selected such that the predetermined minimum color rendering index level is achieved. Advantageously, for the predetermined minimum color rendering index level enhanced color saturation may also be achieved. The mixed light may be emitted by a plurality of light sources or a single light emitting diode with tailored phosphor elements as discussed above.

By adjusting the relative peaks in the wavelength distribution of the illuminating light desired light properties may be achieved such that the color saturation for each peak is enhanced while maintaining a tolerable color rendering index. The desired light properties may alter with different applications. Furthermore, the enhanced output spectrum may be adjusted after the reflection spectrum within the boundary conditions, i.e. a white point and a color rendering index, may be obtained by computing all possible spectra for these parameters and selecting the best matching spectrum. The control parameters for the adjusted spectrum are identified and the pluralities of light sources are configured to emit light accordingly to the identified control parameters.

Further, if the reflection spectrum presents a spectrum with narrow reflection peaks, it may be advantageous for the lighting arrangement to provide light sources with light distributions at the corresponding wavelengths. Furthermore, for achieving suitable illumination lighting the light sources are operated to illuminate the object with light perceived as white light to achieve a desired color rendering index combined with a saturation of the light at the wavelengths corresponding to the reflection peaks. Accordingly, if a broader reflection range is presented in a reflection spectrum then it may be advantageous to have several light sources within that wavelength region such that a combination of light sources may be utilized to be adjusted according to the power distribution in that wavelength region of the reflection spectrum with regards to the desired color rendering index.

Furthermore, the spectral distribution of the illuminating light may be changed such that certain part of the spectrum have stronger contribution while maintaining a constant color temperature. A color mixing light source may create each color point in multiple ways, thereby making it possible to alter the spectrum of the color mixing light source while keeping the color point fixed. From the number of possible illumination spectrum for a specific color point the best matching spectrum for a predetermined color rendering index may be determined.

According to one embodiment of the invention, further comprising a detector in communication with the control unit and provided for identifying the object and a database storing a plurality of pre-stored reflection spectrum, wherein a pre-stored reflection spectrum of the object is acquired from the database comprising the plurality of pre-stored reflection spectrum by identifying the object with the detector, the database comprising set values for color saturation levels and color rendering index levels based on mixed light emitted by the lighting arrangement.

The object may be identified with a detector, and a pre-stored reflection spectrum for said object stored in a database may be acquired. The detector may identify a specific object though color and shape of the object. The detector may be a color camera with software with ability of extracting the illuminating product or object from the image. The reflection spectrum may be received by recognizing the object with a color camera by color and shape and subsequent a reflection spectrum may be found in a database containing reflection spectra for various objects and products. Thus, in a store it may be advantageous to avoid measuring the reflection spectrum; in some applications customers may hinder the measurement of the reflection spectrum of the object. Furthermore, the database may comprise illumination spectra of the plurality of light sources in the lighting arrangement. The illuminating spectrum of the lighting arrangement comprising of a plurality of light sources may also be measured with a sensor for determining the spectral distribution. However, a plurality of various combinations of the light output, i.e. illumination spectra, from the plurality of light sources in the lighting arrangement may be stored in a database with the specific control parameters for each spectrum. The database may comprise values for color saturation levels and CRIs based on a number of illuminating spectra of the plurality of light sources in the lighting arrangement. Illuminating spectral distributions for a color mixing light source may be stored on a database, which fulfills a combination of enhanced color saturation and acceptable color rendering index. An advantage with a database comprising the results of the computations of the color saturation level and color rendering index for illumination spectra that are based on the colors of the plurality of light sources in the lighting arrangement and an existing database of reflection spectra of known objects, is that the required calculations for calculating the relative heights of the illuminating spectrum may be bypassed and a cheap microcontroller may be used.

In one embodiment of the invention, further comprising a sensor in communication with the control unit and configured to measure the reflection spectrum of the object. A sensor built in the casing of the lighting arrangement or in a handheld device for measuring reflection spectra may be used. The sensor may create a histogram of the reflection spectrum in order to compare and to find the best fit for the illumination spectrum.

According to one embodiment of the invention, the color rendering index level of mixed light emitted by the lighting arrangement is at least 70. An advantage with keeping the color rendering index over 70 is that the higher color rendering index the better the light sources may be to represent colors. The color rendering index is a measure of the ability of a light source to reproduce colors in object in comparison to a natural light source. In some application, for example with regard to entertainment and/or stage lighting the color rendering index may be lower around 60.

According to one embodiment of the invention, a perceived color is maintained by adjusting the illumination spectrum based on human eye color sensitivity and control parameters are determined for the mixed light emitted by the lighting arrangement such that the perceived color is achieved. The receptors in the human eye response to light vary due to the wavelength and intensity of the light, there are three types of receptors with different sensitivity to the wavelength of the light. By first adjusting the illumination spectrum to the reflection spectrum, and then adjusting the illumination spectrum based on human eye color sensitivity, less light needs to be emitted from the plurality of light sources which may save energy and reduce damage to light sensitive artifacts. The reflection spectrum may be selected from a database of predefined objects and corresponding predefined desired appearances.

According to one embodiment of the invention, the predetermined parameters comprise a human eye color sensitivity spectrum arranged to weight the illumination spectrum to reduce light emitted by the lighting arrangement. The human eye color sensitivity spectrum comprises three different curves corresponding to human eye color sensitivity. By adjusting the illumination spectrum emitted by the plurality of light sources to the reflection spectrum undesirable wavelengths are removed, since it is the wavelengths absorbed by the object that causes heating or photochemical reactions, and this may be weighted towards the human eye color sensitivity spectrum to reduce the light intensity. By selectively increasing the illumination at wavelengths which are not exclude may create a desirable illumination while excluding the undesirable wavelengths. Furthermore, light which is absorbed by the object does not contribute to the appearance of the object.

In one embodiment of the invention, the object is a light sensitive artifact. Light sensitive artifacts may be any type of object such as artifacts, paintings, photosensitive objects, photosensitive materials, historical artifacts, art, fabrics, documents or paintings. Light sensitive artifacts may be damaged by strong lighting and in most museums the artifacts are often displayed under weak lighting to preserve the objects.

As is known by the skilled person, the human eye is insensitive to wavelengths approximately below 400 nm and above 720 nm. Thus, in line with the inventive concept, by configuring the plurality of light sources to emit wavelengths (only) between 430 nm and 720 nm damage to some light sensitive artifacts may be reduced. Generally, wavelengths with higher energy, such as for example wavelengths below 430 nm, often trigger chemical reactions that may damage the light sensitive artifacts.

According to another aspect of the invention, there is provided a method for controlling a lighting arrangement comprising the steps of determining the object to be illuminated, receiving a reflection spectrum of the object, matching an illumination spectrum to the reflection spectrum of the object based on predetermined parameters relating to the type of object, selecting control parameters for the mixed light emitted by the lighting arrangement, such that an illumination spectrum is matching the reflection spectrum with regard to the type of object and controlling lighting arrangement to emit light according to the selected control parameters. By controlling a lighting arrangement using a method according to the invention the steps of illuminating an object such that the illumination spectrum of the plurality of light sources matches the reflection spectrum may be facilitated, the quality of the illumination may be enhanced with regard to type of object. Features of this aspect of the invention provide similar advantages as discussed above in relation to the previous aspect of the invention.

According to a still further aspect of the present invention there is provided a computer program product comprising a computer readable medium having stored thereon computer program means for causing a control unit to control a lighting arrangement provided for illuminating an object, wherein the computer program product comprises code for determining the type of object to be illuminated, code for receiving a reflection spectrum of the object, code for matching an illumination spectrum to the reflection spectrum of the object based on predetermined parameters relating to the type of object, code for selecting control parameters for the mixed light emitted by the lighting arrangement, such that an illumination spectrum is matching the reflection spectrum with regard to the type of object; and code for controlling the lighting arrangement to emit light according to the selected control parameters. As above, features of this aspect of the invention provide similar advantages as discussed above in relation to the previous aspects of the invention.

Further, the lighting arrangement may comprise a code reader configured to read an object identification code for the object, and retrieve the reflection spectrum corresponding to the object identification code. For example, the code reader may be an RFID reader or a bar code reader. Moreover, the lighting arrangement may comprise a remote control comprising the code reader, for facilitating reading the identification code. Furthermore, the lighting arrangement may comprise a remote control, a measurement device or other identification device, for facilitating manual setting with predetermined settings and alternatives for the type of object to be illuminated.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The aspect of the invention, including its particular features and advantages, will be readily understood from the following detailed description and the accompanying drawings, in which.

DETAILED DESCRIPTION OF THE EMBODIMENTS

Figure 1:
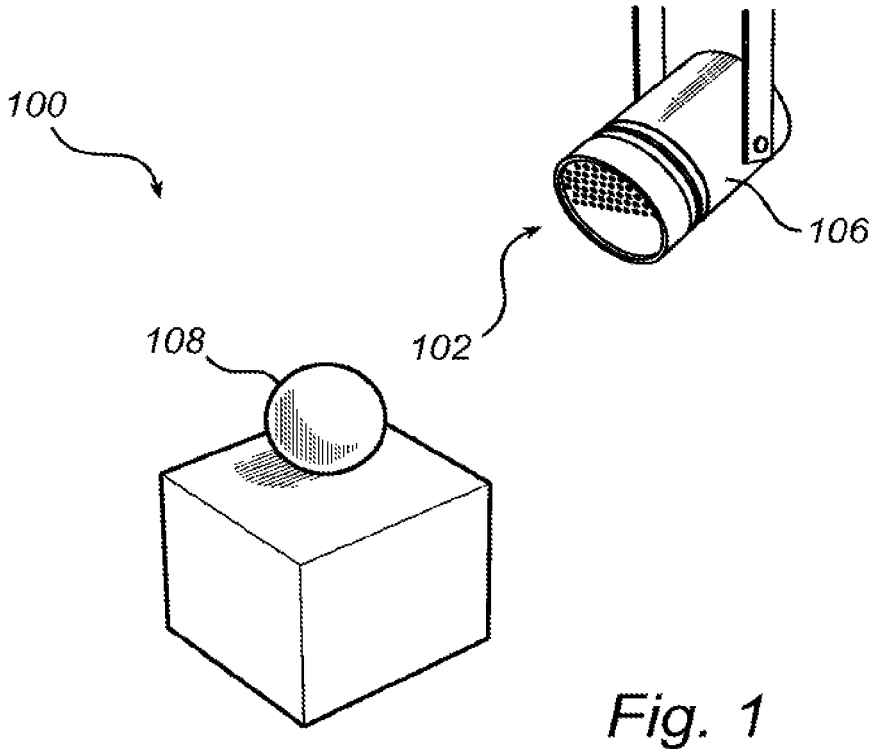
FIG. 1 illustrates an arrangement according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

In FIG. 1 there is depicted an exemplifying lighting arrangement 100 comprising a plurality of light sources 102 arranged in a light emitting device 106 which is configured to illuminate an object 108. Further, each of the plurality of light sources 102 are each arranged to emit a specific (different) color. Additionally, the lighting arrangement also comprises a control unit (not shown) in communication with the plurality of light sources 102. The control unit is here integrated with the light emitting device 106. However, the control unit may alternatively communicate wirelessly with the plurality of light sources 102. The control unit is configured to select control parameters to control the plurality of light sources 102 based on the reflection spectrum of the object. The control unit may include a microprocessor, microcontroller, programmable digital signal processor or another programmable device. The control unit may also, or instead, include an application specific integrated circuit, a programmable gate array or programmable array logic, a programmable device such as the microprocessor, microcontroller or programmable digital signal processor mentioned above; the processor may further include computer executable code that controls operation of the programmable device.

Figure 2:
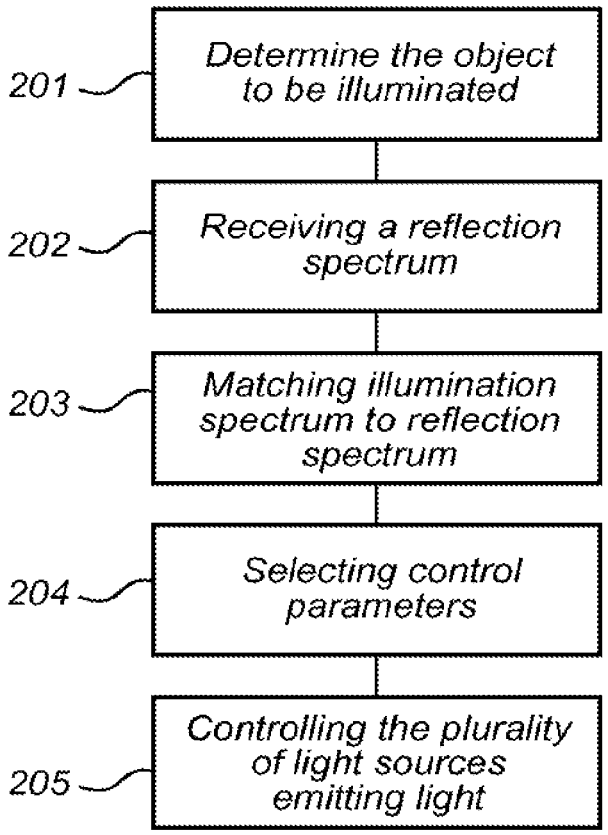
FIG. 2 is a flow chart of the method according to the invention.

In the following operation of the system of FIG. 1 will be described in conjunction with FIG. 2 showing the exemplifying steps for controlling a plurality of light source 102 illuminating an object 108.

In a first step, 201, the object 108 is determined to belong to a specific type of object. The type of object will influence in what type of setting the object will be illuminated and how the illumination light will be controlled. A commercial product, such as an orange or banana, may be placed in stores where customers will be walking around the products and be illuminated be the same illumination light as the products. Another type of object is light sensitive object or artifacts, such as paintings displayed in for example museums. The illumination in museums is often directed directly towards the painting so the visitors of the museum will rarely be illuminated by the lighting arrangement.

In a second step 202, the lighting arrangement receives a reflection spectrum of the object. The reflection spectrum may be acquired by using a detector to capture the color and shape of the object and a control unit that identifies the object from a database with information of reflection spectrum, color and shapes of objects. The object may also be identified using RFID readers. Alternatively, the reflection spectrum is obtained by measuring the reflection spectrum with a sensor that creates a histogram when illuminated with a reference light source.

In a third step, 203, the illumination spectrum, which comprises the light emitted by the plurality of light sources, is arranged to match the reflection spectrum of the object. By adjusting the illumination spectrum to the reflection spectrum the object may enhance emphasize on the object. Furthermore, the amount of light needed to illuminate an object may be decreased and by utilizing light that will be reflected by the object damages may be avoided that can be traced back to the illumination since light absorbed by the object may heat or trigger photochemical reactions.

As a fourth step, 204, the control parameters are selected such that the illumination spectrum is adjusted based on the type of object. The light emitted from the lighting arrangement arranged in a store illuminating commercial products may need to adjust the composition of the light such that the light will be perceived as white or close to white light. For commercial products arranged in situation where customers or people are illuminated with the same light the color rendering index level is set such that the customers are not walking around looking for example green. Furthermore, the saturation level for the illumination is also enhanced while keeping the color rendering index level. However, in the case with the painting in the museum, the surroundings are not of the same importance because the visitors are not illuminated by the lighting arrangement and the desire to alter the composition of the light due to the visitors is less important, however the light directed towards the painting may instead need adjustments to reduce damage to the painting caused by lighting. The lighting may be adjusted based on human eye color sensitivity, such that less light is used to illuminate the object while preserving perceived brightness. The control parameters may be received from a database storing all the control parameters for each illumination spectrum or by calculating the parameters.

In the fifth step, 205, the plurality of light sources emits light according to determined control parameters.

Figure 3:
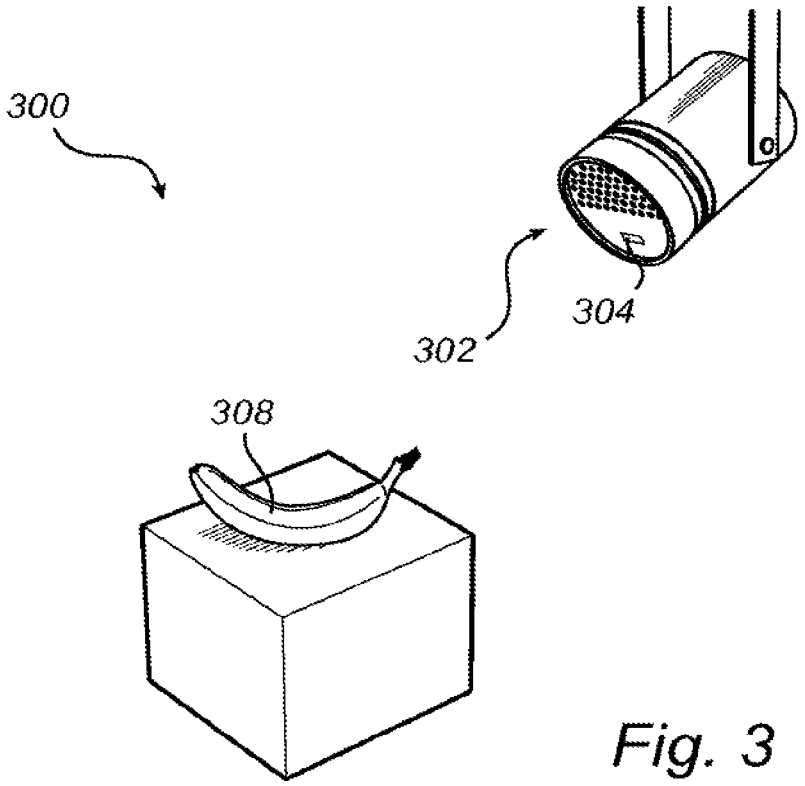
FIG. 3 illustrates an arrangement according to an embodiment of the present invention comprising a detector.

In FIG. 3 there is depicted an exemplifying lighting arrangement 300 comprising a plurality of light sources 302, a detector 304. The plurality of light sources 302 are arranged in a light emitting device 306 which is configured to illuminate an object 308, here a single banana. Further, the light emitting device 306 is in this case a color mixing light source comprising the colors RGBA. Additionally, the light emitting device may comprise a detector 304, as in the illustrated case, configured to detect the color and shape of the object. Alternatively, the detector 304 may be arranged as a unit separated from the light emitting device 306. The lighting arrangement 300 also comprises a control unit (not shown) as described in FIG. 1 which is in communication with the detector 304 and the plurality of light sources 302. The control unit is here configured to determine the reflection spectrum of the object based on the information given by the detector, select control parameters to control the plurality of light sources 302 based on the reflection spectrum of the object, a predetermined minimum color rendering level and saturation level of the illumination light.

Figure 4:
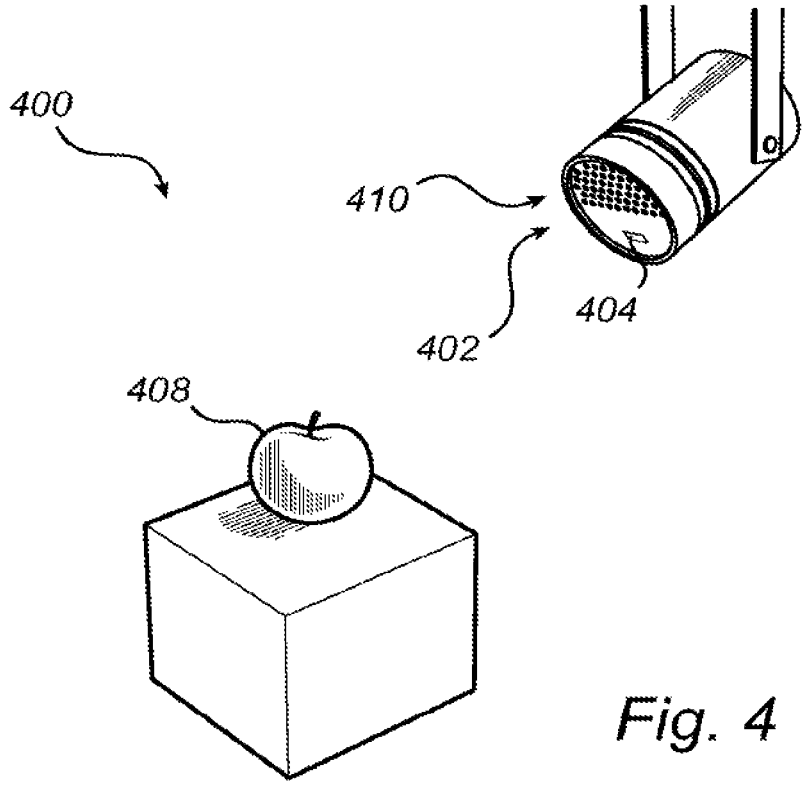
FIG. 4 illustrates an arrangement according to an embodiment of the present invention comprising a sensor.

In FIG. 4, there is depicted an exemplifying lighting arrangement 400 comprising a plurality of light sources 402, a sensor 404 and a reference light source 410. The plurality of light sources 402 arranged in a color mixing light source is illuminating an object, here a single apple 408. The plurality of light sources 402 is a combination of narrow band light emitting diodes each with a separate color and phosphor converted LEDs with a white band spectrum. In this case, the sensor 404 measures the reflection spectrum of the object when a reference light source 404 is illuminating the object. The lighting arrangement 400 also comprises a control unit (not shown) as described in FIG. 1. The control unit communicates with the sensor 404 to receive the reflection spectrum of the object. Further, the control unit determines the control parameters for the illumination output distribution of the plurality of light sources with the best match with regards to the reflection spectrum and the predetermined color rendering level and the saturation level. Alternatively, the plurality of light sources 402 is also the reference light source 410. Furthermore, the sensor 404 and the reference light source 410 may be arranged separate from the color mixing light source 406. Optionally, the lighting arrangement 400 may also comprise a remote control, which may comprise the sensor 404 and the reference light source 410.

Figure 5A:
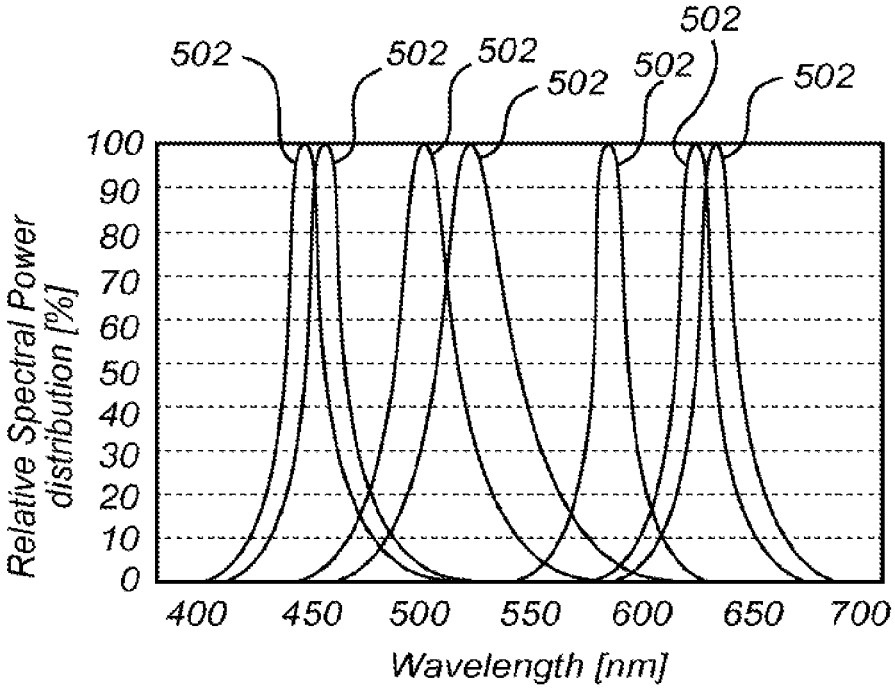
FIG. 5*a* illustrates the spectral distribution of a plurality of LEDs with different colors.
Figure 5B:
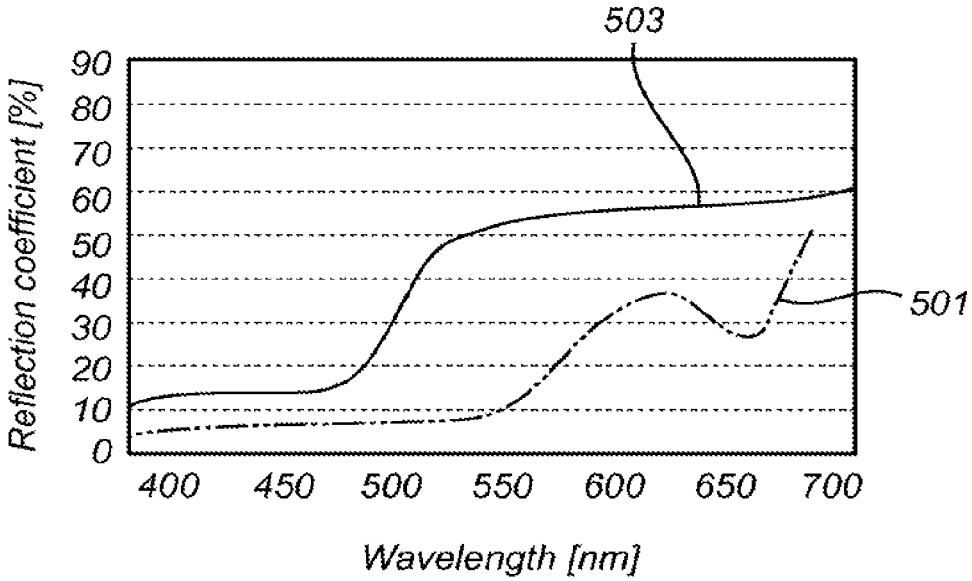
FIG. 5*b* illustrates a reflection spectrum with narrow reflection peaks and a reflection spectrum with a broader reflection distribution.

In FIG. 5*a* there is depicted the spectral distribution 502 of several narrow band light emitting diodes of different colors and may function as the plurality of light sources in the lighting arrangement in FIG. 3-4. While FIG. 5*b* presents exemplifying reflection spectra of different object with either narrow reflection peaks 501 or a broader reflection distribution 503. For objects with a reflection spectrum with clearly defined peaks 501, for example with a dominant wavelength at 590 nm and 630 nm, the narrow band light emitting diodes with a output distribution at those wavelength may be enhanced. However, for achieving a suitable light with respect to the predetermined color rendering index level all of the plurality light sources in the lighting arrangement are operated to illuminate the object with light that may be considered as white light saturated around 590 and 630 nm. However, for a reflection spectrum a broader distribution with higher reflection 503, multiple light emitting diodes may be combined in the distribution of higher reflection while the number and power of light emitting diodes used in a wavelength region is restricted by the level of the color rendering index. Alternatively, narrow band light emitting diodes may be combined with for example phosphor converted light emitting diodes with a wider spectrum to be able to emphasize objects with a wider reflection spectrum. The lighting arrangement will be described with reference to both FIGS. 3 and 4. Firstly, a reflection spectrum of the object is obtained for a lighting arrangement illuminating an object. With reference to FIG. 3, the detector 304 captures the color and shape of the object and a control unit identifies the object from a database with that given information, which also comprises the reflection spectrum for each of the object for a given reference light. Alternatively, the reflection spectrum is obtained by measuring the reflection spectrum with a sensor 404 that creates a histogram when illuminated with a reference light source, as in FIG. 4. Then a predetermined minimum color rendering index is received. The predetermined minimum color rendering index may be stored in a database for each of the objects. However, it may also be possible to be able to select the predetermined minimum color rendering level depending on the application. In a window display the predetermined color rendering level may be set to a lower value than for a lighting arrangement illuminating a fresh food in a store. For fresh food such as vegetables and fruit a CRI value of 70 is acceptable for color emphasis. For shop windows with toys for example much stronger colored light effects may be preferred and lower CRI values such as 60 may be used to illuminate the products and create attraction power. The color rendering index level is advantageously set as an adjustable parameter depending on the requirements of the application. The control parameters of the illumination light are selected based on which illumination spectrum best matches the reflection spectrums while the predetermined minimum color rendering level. The control parameters of the plurality of light sources best matching the reflection spectrum with an enlarged saturation is selected, such that the boundary conditions being a specific white point and a minimum color rendering index level is achieved. The control unit may for all possible spectra compute these parameters and the best matching spectrum may be determined. The control parameters for the best matching spectrum are then identified. The different control parameters correspond to altering the relative power of the light sources arranged in the lighting arrangement according to the boundary conditions. The saturation level is calculated by the color of the object under reference light source and under the light that will illuminate the object. The colors are converted to hue and chroma according to CIELAB definition. Thereafter, the relative chroma shift is calculated and the saturation index is received by multiplying with a constant that preferable is 100 to have the same order of magnitude as the color rendering index values. Color rendering index value is calculated according to well known theory. The plurality of light sources is adjusted according to the identified control parameters to exaggerate the colors of the object.

Figure 6:
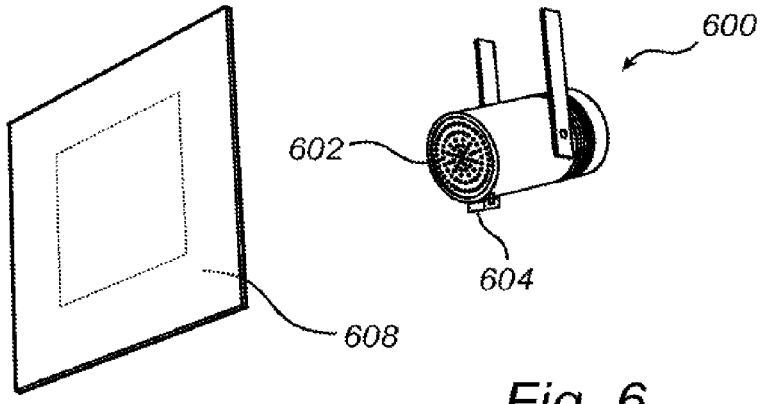
FIG. 6 illustrates an illumination arrangement illuminating a light sensitive artifact.

In FIG. 6 the illumination arrangement 100 as described in FIG. 1 is illuminating a light sensitive artifact 608, which in this case is a painting. In this embodiment, the illumination arrangement 600 may comprise a detector 604 and a database. The detector 604 is configured to detect the object and is identified with the stored information in the database. The database may further comprise information regarding certain harmful wavelengths which is not to be emitted by the plurality of light sources while illuminating that particular object. The harmful wavelengths may be avoided by specified control parameters or by using filters. Additionally, the database may comprise information regarding the curves for the spectral human eye color sensitivity. The plurality light sources 602 used in the lighting device 606 may be a combination of colored light emitting diodes or lasers. The illumination arrangement 600 described in FIG. 6 may be may be applied in areas where photosensitive objects are displayed. It could be used in museums, art galleries, archeological research labs and private displays where photosensitive artifacts are displayed or used. Additionally, the illumination arrangement could be used in industrial processes involving photosensitive materials.

Figure 7:
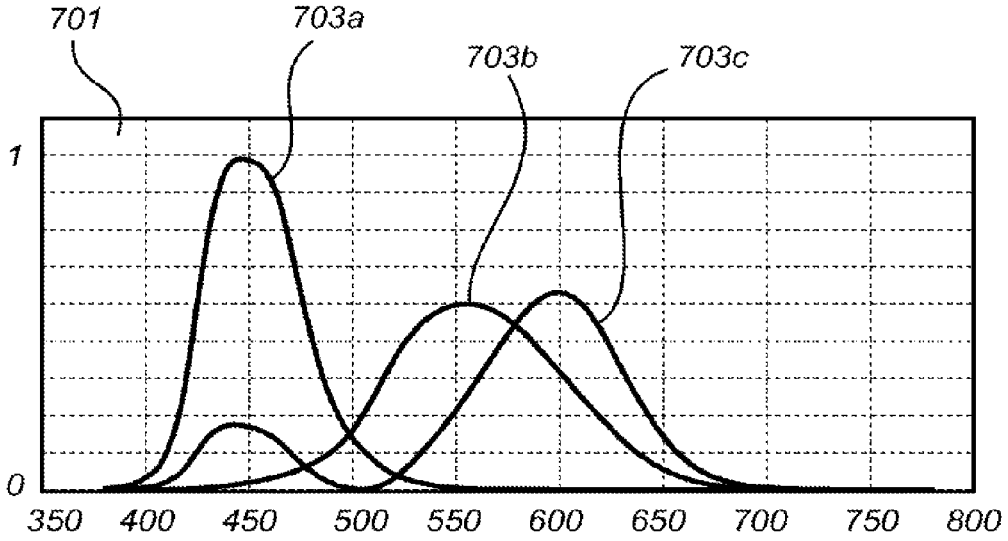
FIG. 7 illustrates curves for Human Eye Color Sensitivity.

In FIG. 7 the spectral response of human eye receptors, 703*a*, 703*b*, and 703*c* is depicted. The human eye responds to colored light using red, green and blue receptors and the light from the lighting arrangement illuminating light sensitive objects may apart from match the reflection spectrum also be weighted to the human eye sensitivity spectrum 701. Once undesirable wavelengths of light have been removed by matching the illumination spectrum with the reflection spectrum of the object, selectively increasing the illumination at wavelengths which are not excluded may create a desirable apparent illumination while still excluding undesirable wavelengths by weighting the illumination spectrum towards wavelengths where the human eye is most sensitive. By weighting the illumination spectrum with the human eye sensitivity spectrum 701 may reduce the light intensity needed to illuminate the object.

Figure 8A:
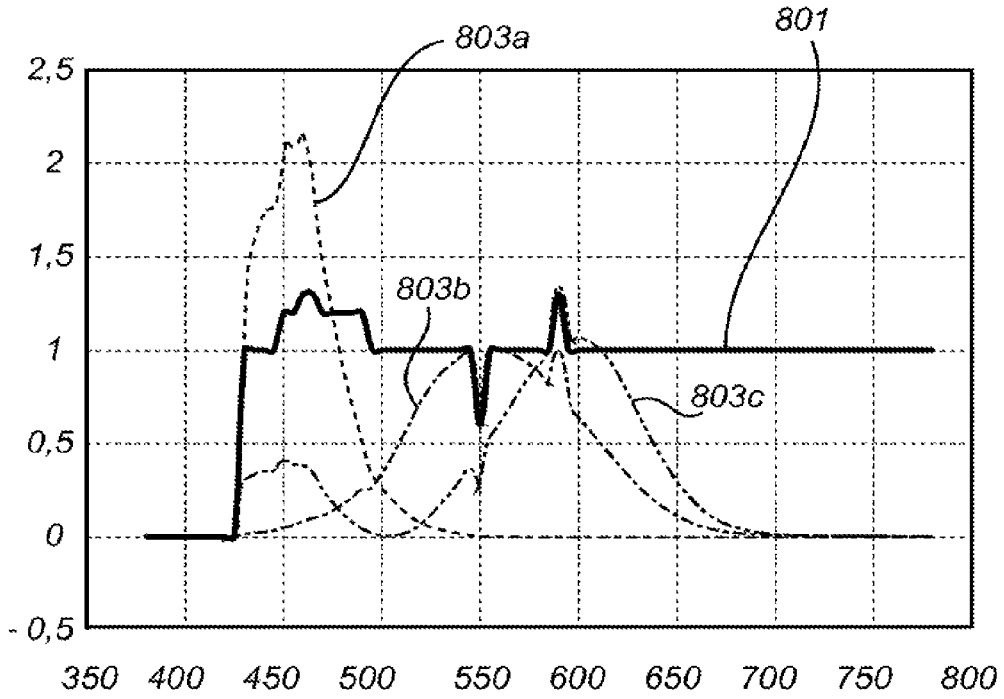
FIG. 8*a* illustrates the illumination spectrum as well as the response of light based on human eye color sensitivity where the light source is adjusted to remove light below 430 nm.

FIG. 8*a* illustrates the illumination spectrum 801 as well as the response of light based on the eye receptor 803*a-c* where the light source is adjusted to remove light below 430 nm. Generally, wavelengths below 430 nm have high energy and may be absorbed by light sensitive artifacts which may induce heating or photochemical reaction. Photochemical reactions or heat may damage sensitive artifacts such that the colors of the artifact fade or decay. For light sensitive object such as paintings, artifacts, art, historical object, light sensitive materials, the plurality of light sources may illuminate the objects with wavelengths between 430 nm and 700 nm. To maintain the same perceived color the wavelengths may be adjusted.

Figure 8B:
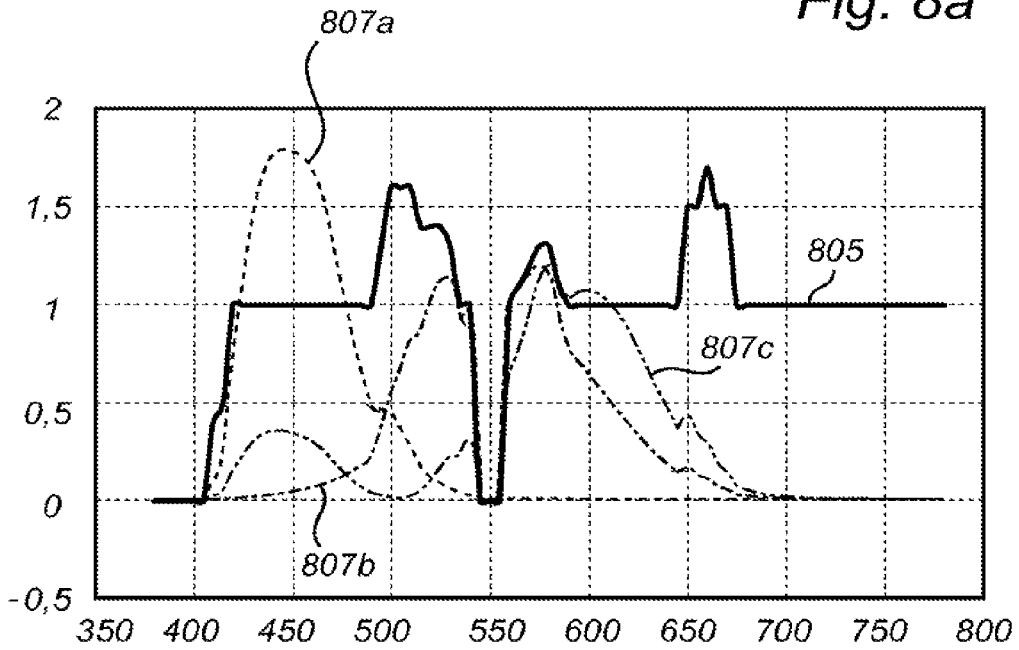
FIG. 8*b* illustrates the illumination spectrum as well as the response of light based on human eye color sensitivity where the light source is adjusted to remove specific wavelengths around 550 nm.

In FIG. 8*b* the illumination spectrum 805 as well as the response of the light based on the eye receptor 807*a-c* is illustrated, where a narrow wavelength range has been removed from the light outputted by the plurality of light sources. The object illuminated may be identified with a detector or a sensor in communication with a database comprising information regarding light sensitive object, reflection spectrum, wavelengths specifically harmful to light sensitive object. These wavelengths are not used by the plurality of light sources when illuminating the particular object. In FIG. 8*b* the light is removed at a wavelength around 550 nm and the remaining spectra is adjusted to maintain the same perceived appearance.

Even though the invention has been described with reference to specific embodiments thereof, many different alterations, modifications and the like will become apparent for those skilled in the art. For example, the lighting arrangement illuminating a light sensitive object may still adjust the light output to get an appropriate color temperature or appearance and the light output for the lighting arrangement illuminating commercial products may not emit certain wavelengths to avoid damaging the object. Parts of the system may be omitted, interchanged or arranged in various ways, the system yet being able to perform the method of the present invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. A lighting arrangement configured to illuminate an object, the lighting arrangement configured to emit light of a plurality of colors, the lighting arrangement comprising a control unit configured to:

determine the type of object to be illuminated;

receive a reflection spectrum of the object;

select control parameters for controlling mixed light emitted by the lighting arrangement, the mixed light having an illumination spectrum matching the reflection spectrum of the object based on predetermined parameters relating to the type of object; and control the lighting arrangement for illuminating the object with said illumination spectrum based on the selected control parameters, wherein the lighting arrangement further comprises a detector in communication with the control unit provided for identifying the object, and a database storing a plurality of pre-stored reflection spectra, wherein a pre-stored reflection spectrum of the object is acquired from the database comprising the plurality of pre-stored reflection spectra, and wherein, for a first object type, the illumination spectrum matches a reflection spectrum for the first object type to a lesser degree than the illumination spectrum for a second object type matches a reflection spectrum of the second object type such that the illumination spectrum for the first object type is whiter than the reflection spectrum for the first object type.

2. The lighting arrangement according to claim 1, further comprising a plurality of light sources arranged to emit the mixed light.

3. The lighting arrangement according to claim 1, wherein the predetermined parameters comprise a predetermined minimum color rendering index level of the mixed light emitted by the lighting arrangement, wherein the control unit is configured to select parameters for the mixed light emitted by the lighting arrangement such that the predetermined minimum color rendering index level is achieved.

4. The lighting arrangement according to claim 3, wherein a color rendering index level of mixed light emitted by the lighting arrangement is at least 70.

5. The lighting arrangement according to claim 1, wherein the database comprises results of computations of color saturation level and color rendering index for illumination spectra that are based on colors of a plurality of light sources in the lighting arrangement.

6. The lighting arrangement according to claim 1, further comprising a sensor in communication with the control unit and configured to measure the reflection spectrum of the object.

7. The lighting arrangement according to claim 1, wherein the control unit is configured to maintain a perceived color by adjusting the illumination spectrum matching the reflection spectrum of the object based on human eye color sensitivity, and control parameters are determined for the mixed light emitted by the lighting arrangement, such that the perceived color is achieved.

8. The lighting arrangement according to claim 1, wherein the predetermined parameters comprises a human eye color sensitivity spectrum, wherein the control unit is arranged to weight the illumination spectrum matching the reflection spectrum of the object to the human eye color sensitivity spectrum to reduce light emitted by the lighting arrangement.

9. The lighting arrangement according to claim 1, wherein the detector is configured to identify the object through color and shape of the object.

10. A method for controlling a lighting arrangement, comprising the steps of:

determining the type of object to be illuminated;

receiving a reflection spectrum of the object;

matching an illumination spectrum to the reflection spectrum of the object based on predetermined parameters relating to the type of object;

selecting control parameters for the mixed light emitted by the lighting arrangement, such that said illumination spectrum matches the reflection spectrum with regard to the type of object;

controlling the lighting arrangement to emit light according to the selected control parameters, wherein the method further comprises the steps of:

identifying the object with a detector; and acquiring a pre-stored reflection spectrum for said object from a database, wherein, for a first object type, the illumination spectrum matches a reflection spectrum for the first object type to a lesser degree than the illumination spectrum for a second object type matches a reflection spectrum of the second object type such that the illumination spectrum for the first object type is whiter than the reflection spectrum for the first object type.

11. The method for controlling a lighting arrangement according to claim 10, further comprising the steps of:

setting a predetermined minimum color rendering index level of mixed light emitted by the lighting arrangement; and selecting control parameters for the mixed light emitted by lighting arrangement such that the predetermined color rendering index level is achieved.

12. The method for controlling a lighting arrangement according to claim 11, wherein the database further comprises results of computations of color saturation level and color rendering index for illumination spectra that are based on colors of a plurality of light sources in the lighting arrangement.

13. The method for controlling a lighting arrangement according to claim 11, further comprising the step of acquiring the reflection spectrum by measuring the reflection spectrum of the object with a sensor.

14. The method for controlling a lighting arrangement according to claim 10, further comprising the steps of:

maintaining a perceived color by adjusting the illumination spectrum matching the reflection spectrum of the object based on human eye color sensitivity;

selecting control parameters for the mixed light emitted by the lighting arrangement such that the perceived color is achieved.

15. The method for controlling a lighting arrangement according to claim 10, further comprising the step of:

weighting the illumination spectrum matching the reflection spectrum of the object with a human eye color sensitivity spectrum.

16. A computer program product comprising a non-transitory computer readable medium having stored thereon a computer program for causing a control unit to perform the method according to claim 10.

17. The method according to claim 10, wherein the object is a light sensitive artifact.

18. The method according to claim 10, wherein the mixed light is configured to illuminate both the object and a viewer of the object for the first object type, and wherein the mixed light is configured to illuminate the object and not illuminate the viewer of the object for the second object type.

19. The lighting arrangement according to claim 1, wherein the mixed light is configured to illuminate both the object and a viewer of the object for the first object type, and wherein the mixed light is configured to illuminate the object and not illuminate the viewer of the object for the second object type.

* * * * *